US010337263B2

(12) United States Patent
Pratt et al.

(10) Patent No.: US 10,337,263 B2
(45) Date of Patent: Jul. 2, 2019

(54) METHOD AND APPARATUS FOR HANDLING A TUBULAR

(71) Applicant: Weatherford Technology Holdings, LLC, Houston, TX (US)

(72) Inventors: Brittan S. Pratt, Houston, TX (US); Karsten Heidecke, Houston, TX (US); Scott McIntire, Houston, TX (US); Aaron Sinnott, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 736 days.

(21) Appl. No.: 14/043,723

(22) Filed: Oct. 1, 2013

(65) Prior Publication Data

US 2014/0131051 A1 May 15, 2014

Related U.S. Application Data

(60) Provisional application No. 61/709,118, filed on Oct. 2, 2012, provisional application No. 61/717,567, filed on Oct. 23, 2012.

(51) Int. Cl.

| | |
|---|---|
| ***E21B 19/16*** | (2006.01) |
| ***E21B 19/06*** | (2006.01) |
| ***E21B 19/24*** | (2006.01) |
| ***E21B 19/12*** | (2006.01) |

(52) U.S. Cl.

CPC ..... *E21B 19/16* (2013.01); *E21B 19/06* (2013.01); *E21B 19/12* (2013.01); *E21B 19/24* (2013.01)

(58) Field of Classification Search

CPC ..... E21B 19/16

See application file for complete search history.

(56) References Cited

U.S. PATENT DOCUMENTS

| | | | | |
|---|---|---|---|---|
| 2,719,025 | A * | 9/1955 | Stone | E21B 17/16 173/167 |
| 3,043,619 | A * | 7/1962 | George | E21B 19/06 294/131 |
| 3,094,852 | A * | 6/1963 | Taylor | E21B 19/10 138/142 |
| 3,475,038 | A * | 10/1969 | Matherne | E21B 19/24 285/27 |
| 3,576,062 | A * | 4/1971 | Matherne | E21B 19/16 29/240 |
| 4,509,600 | A | 4/1985 | Boudreaux et al. | |
| 4,599,778 | A * | 7/1986 | Dreyfuss | E21B 19/16 29/272 |

(Continued)

OTHER PUBLICATIONS

PCT Partial International Search Report for International Application No. PCT/US2013/063131 dated Nov. 19, 2014.

(Continued)

*Primary Examiner* — Shane Bomar
*Assistant Examiner* — Steven A MacDonald
(74) *Attorney, Agent, or Firm* — Patterson + Sheridan, LLP

(57) ABSTRACT

A method of running tubulars includes attaching a load collar to a first tubular; landing the load collar on a load support member; connecting a second tubular to the first tubular; removing the load collar from the first tubular; and lowering the first tubular and the second tubular. In one embodiment, at least one of the first tubular and the second tubular is a screen.

26 Claims, 20 Drawing Sheets

(56) References Cited

U.S. PATENT DOCUMENTS

| | | | | | |
|---|---|---|---|---|---|
| 4,654,950 | A * | 4/1987 | Maidlow | E21B 19/16 | 29/272 |
| 4,697,830 | A * | 10/1987 | Wood | B25B 5/147 | 138/96 T |
| 6,237,684 | B1 * | 5/2001 | Bouligny, Jr. | E21B 19/10 | 166/75.14 |
| 6,386,283 | B1 * | 5/2002 | Mosing | E21B 19/10 | 166/75.14 |
| 7,025,147 | B2 * | 4/2006 | Adams | E21B 19/002 | 166/368 |
| 7,997,333 | B2 * | 8/2011 | Angelle | E21B 19/07 | 166/77.52 |
| 2001/0025551 | A1 * | 10/2001 | Pietras | E21B 19/164 | 81/57.34 |
| 2002/0096337 | A1 * | 7/2002 | Bouligny | E21B 19/00 | 166/379 |
| 2005/0092500 | A1 * | 5/2005 | Otten | E21B 19/06 | 166/380 |
| 2009/0242192 | A1 * | 10/2009 | Jensen | E21B 19/24 | 166/208 |
| 2014/0083676 | A1 * | 3/2014 | Miner | E21B 19/24 | 166/85.5 |

OTHER PUBLICATIONS

PCT International Search Report and Written Opinion for International Application No. PCT/US2013/063131 dated Feb. 5, 2015.
Canadian Office Action dated Feb. 29, 2016, for Canadian Patent Application No. 2,886,088.
Australian Patent Examination Report dated Dec. 23, 2015, for Australian Patent Application No. 2013327070.

* cited by examiner

METHOD AND APPARATUS FOR HANDLING A TUBULAR

BACKGROUND OF THE INVENTION

Field of the Invention

Embodiments of the present invention generally relate to methods and apparatus for running a tubular such as a screen.

Description of the Related Art

Downhole screens are frequently used in the oil and gas industry to filter out sand or other particulates. Because of the porous nature of the screens, it is sometimes difficult to handle the screen without damaging it.

There is a need, therefore, for apparatus and methods for handling a screen.

SUMMARY OF THE INVENTION

In one embodiment, a method of running tubulars includes attaching a load collar to a first tubular; landing the load collar on a load support member; connecting a second tubular to the first tubular; removing the load collar from the first tubular; and lowering the first tubular and the second tubular.

In another embodiment, a method of running tubulars includes attaching a load collar to a first tubular; landing the load collar on a load support member; positioning a stabbing guide on the load collar; and connecting a second tubular to the first tubular. In another embodiment, at least one of the first tubular and the second tubular comprises a screen.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to apparatus and methods for handling a tubular. In one embodiment, a load collar is installed on a first tubular, which is lowered onto a load support member. A second tubular is then connected to the upper end of the first tubular. The second tubular may be equipped with another load collar. Prior to connecting the second tubular, an optional stabbing guide may be disposed on the load collar to facilitate alignment and connection to the first tubular. After connection, the load collar on the first tubular is removed and the load support member may be opened to allow the first tubular to pass the rotary table. Thereafter, the load support member is closed and ready to engage the load collar on the second tubular.

Figure 1:
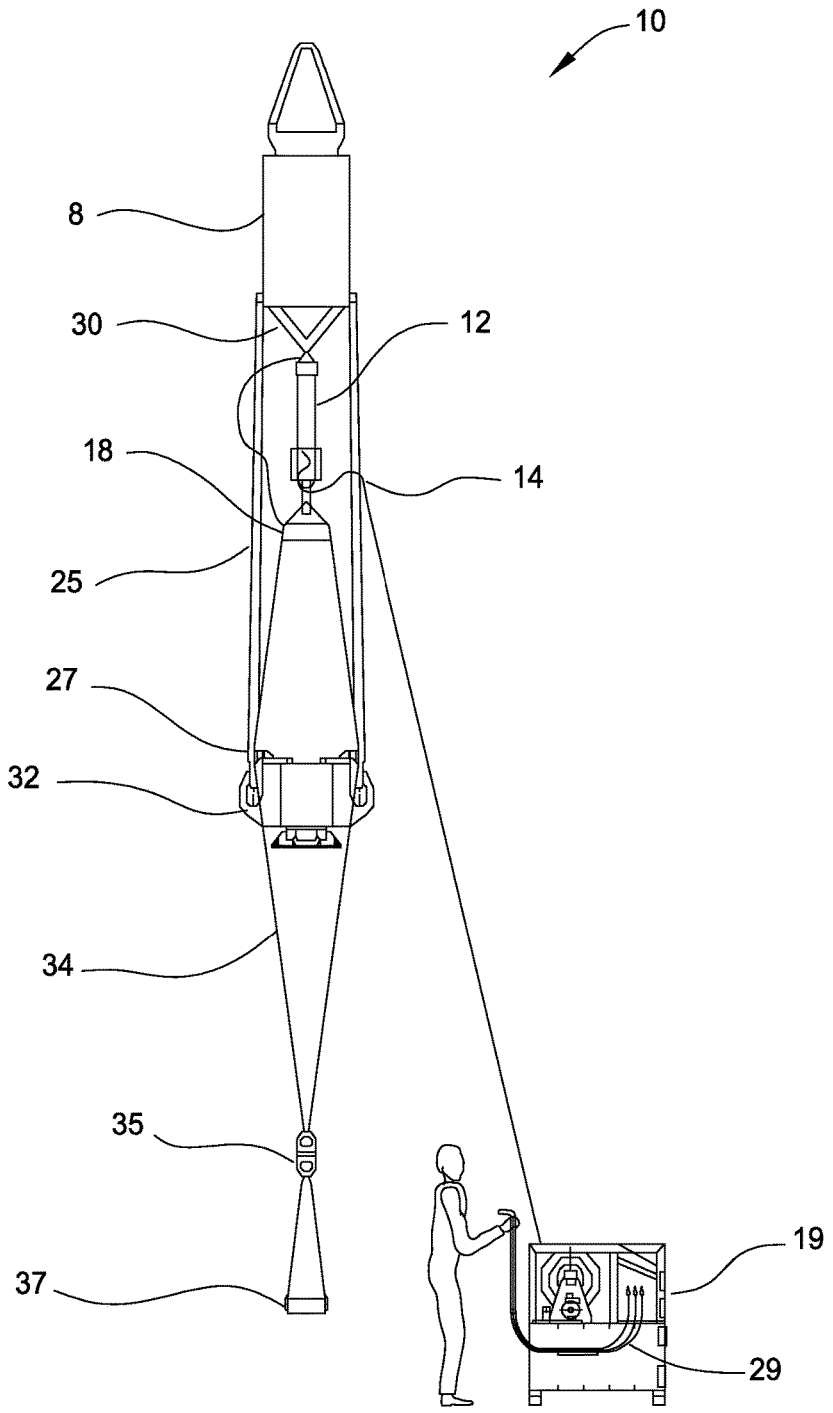
FIG. 1 illustrates a hoisting and compensation configuration.

FIG. 1 shows an exemplary embodiment of a tubular handling system 10 for handling a tubular. In one embodiment, the tubular may be a screen, or other types of tubulars such as drill pipe and casing. The tubular handling system 10 includes a traveling block 8 and elevator bails 25. The bails 25 suspend an elevator 32 such as an automatic side door elevator ("ASD"). A hook 30 couples a compensator 12 such as a single joint compensator to the traveling block 8. A cable plate 18 coupled to the lower end of the compensator 12 supports lifting cables 34 having an elevator 37 attached to the cables' lower end. An exemplary elevator 37 is a stabberless single joint elevator. Guide blocks 27 on the ASD 32 include guide rollers to facilitate movement of the lifting cables 34 relative to the ASD 32. A swivel 35 may be provided below the compensator 12 to allow rotation of the tubular such as a screen. An optional safety cable is provided with the compensator 12. The tubular handling system 10 may include a control panel 19 for the ASD 32 and the compensator 12. The control lines 14 may be coupled to the control panel 19, which may include a remote control 29 for the operator.

Figure 2:
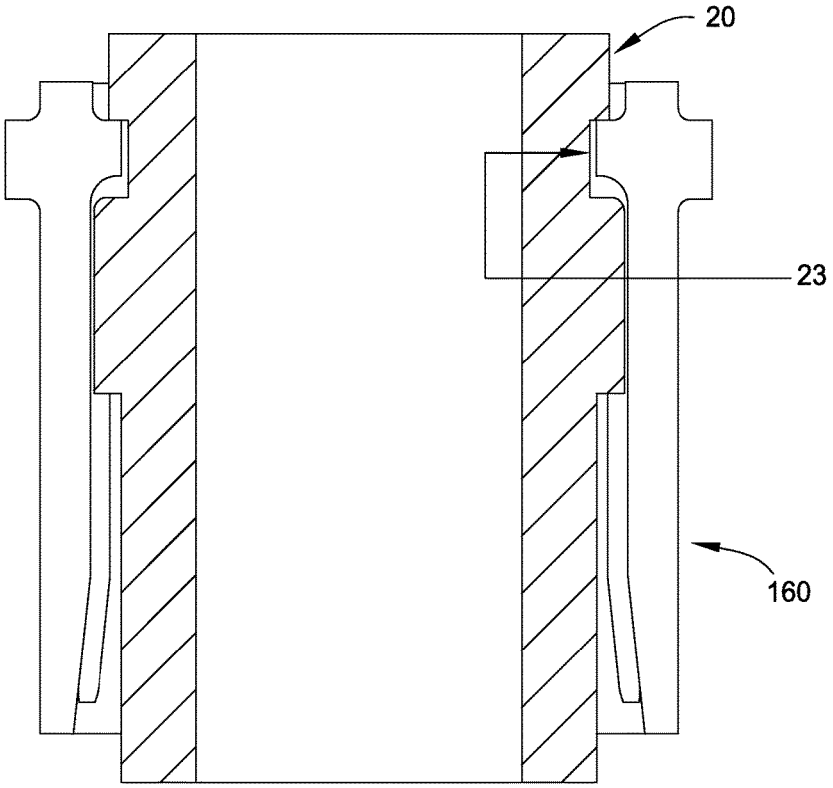
FIG. 2 shows a partial view of an exemplary load collar coupled to a tubular.

FIG. 2 is a perspective, partial view of an exemplary embodiment of a tubular such as a screen 20 having a small gripping area 23 for receiving a handling device such as a load collar 160. In one embodiment, the small gripping area 23 is a recess formed around the exterior of the screen 20. The screen 20 may be picked up by the single joint elevator 37 at the V-door from a pipe delivery system. The traveling block 8 may be lifted to hoist the screen 20 vertically and position the screen in the derrick for make-up. Although a screen 20 is described, it is contemplated that other types of tubular such as drill pipe and casing may be provided with the gripping area 23.

Figure 3:
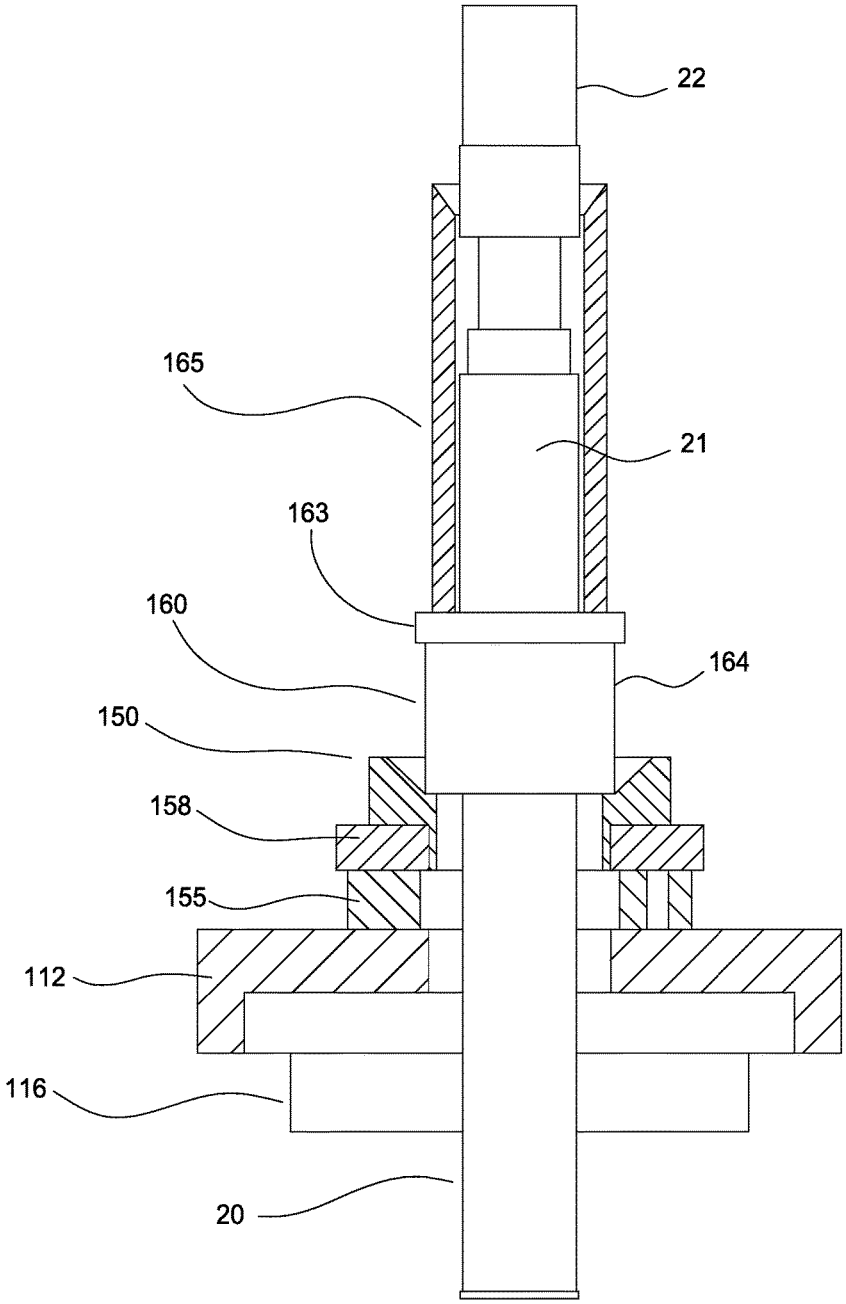
FIG. 3 illustrates an exemplary tubular handling system.

FIG. 3 illustrates a screen 20 or a string of screens supported by a collar support 150. The screen 20 is shown having a first screen 21 connected to a second screen 22. The collar support 150 is disposed on a sliding collar table 112, which, in turn, is shown on top of the rig floor 116. In another embodiment, the collar support 150 may be disposed on a sliding collar table 112. An optional shock absorber 155 may be provided below the collar support 150 to absorb load transfer shocks, such as during landing of the screen 20 on the collar support 150. An optional load transfer member such as a plate 158 may be used to transfer load to the shock absorber 155 and/or to spread the load over a larger surface area. In one embodiment, the sliding collar table 112 includes guides to allow for misalignment inside the master bushing. In one embodiment, the collar support 150 has an annular shape and includes two halves that can separate from each other. For example, the two halves can be brought together to support the screen 20 and moved apart to allow the screen 20 to pass through. In one embodiment, the two halves of the collar support 150 are coupled together using a connection member such as a hinge. In another embodiment, the two halves are not physically coupled to each other. As shown, the collar support 150 includes an optional profile such as a recess for receiving a load collar 160, which is attached to the screen 20. In one embodiment, the recess is sized to centralize the load collar 160 in the collar support 150. Inclines may be provided to guide the load collar 160 onto the recess.

Figure 7A:
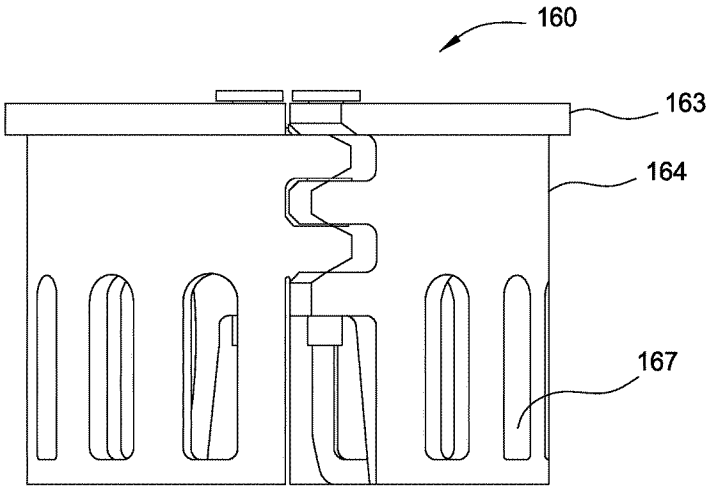
FIGS. 7A-7C illustrate an exemplary load collar.
Figure 7C:
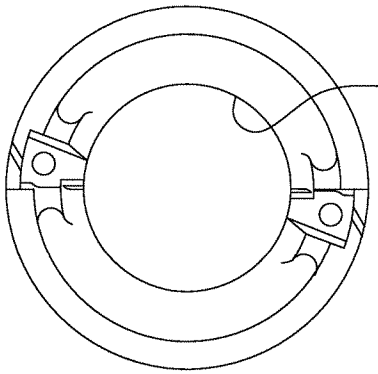
Figure 7B:
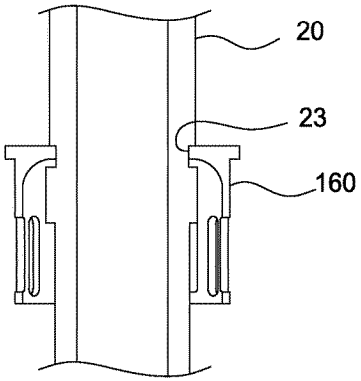

FIGS. 2, 3, and 7B are different views of the load collar 160 coupled to the screen 20. FIG. 3 is a perspective view of the load collar 160 and FIG. 7B is a cross-sectional view of the load collar 160. The load collar 160 facilitates handling of the screen 20. The load collar 160 may include a tubular body 164 and an upper surface having an opening 166 sized to engage the gripping area 23 of the screen 20. The opening 166 is smaller than the inner diameter of the load collar 160. The load collar 160 also includes a flange 163 on its outer surface. The flange 163 has an outer diameter that is larger than the outer diameter of the tubular body 164 of the load collar 160. FIGS. 7A and 7B illustrate an exemplary the load collar 160 having at least two portions that are coupled to each other using one or more hinges to allow opening and closing of the load collar 160. FIG. 7C is a bottom view of the load collar 160 of FIG. 7A. The load collar 160 may include one or more cut outs 167 in the body 164 to reduce the weight of the load collar 160.

Figure 8A:
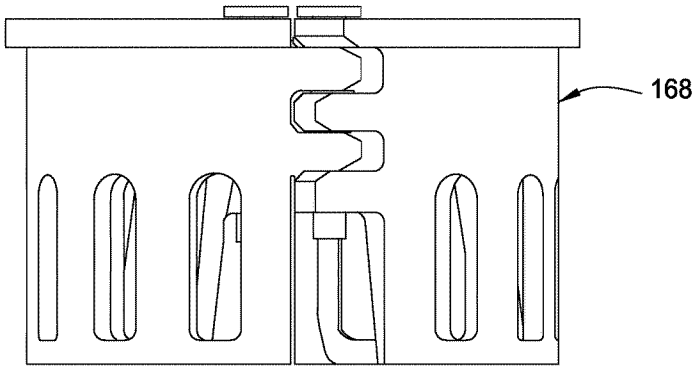
FIGS. 8A-8C illustrate another exemplary embodiment of a load collar.
Figure 8C:
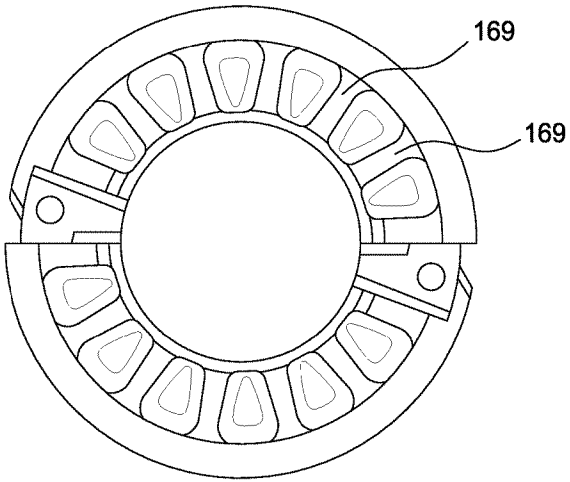
Figure 8B:
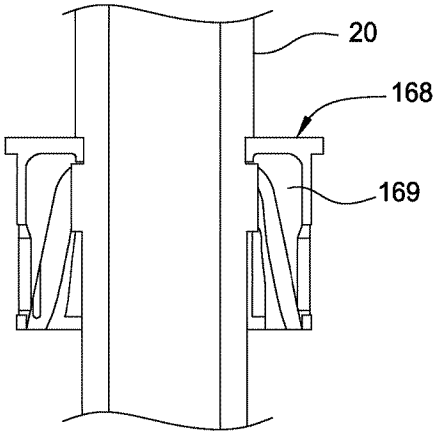

FIGS. 8A-8C show different views of yet another embodiment of a load collar 168. FIG. 8A is a perspective view of the load collar 168. FIG. 8B is a cross-sectional view of the load collar 168 coupled to a screen 20. FIG. 8C is a bottom view of the load collar 168. In this embodiment, the load collar 168 is provided with ribs 169 that extend along the interior of the load collar 168 to provide additional structural support. In this respect, a load collar 168 may be provided with ribs 169 to support a higher string weight.

Figure 9:
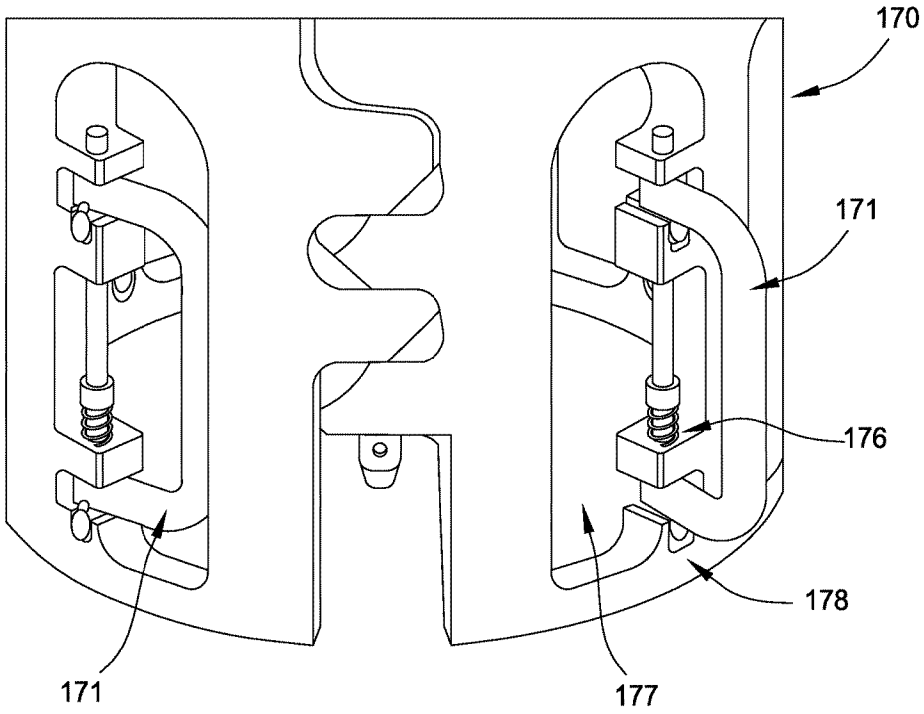
FIG. 9 illustrates another exemplary embodiment of a load collar.

FIG. 9 illustrates a partial view of another embodiment of a load collar 170. In this embodiment, the load collar 170 includes one or more handles 171 to facilitate handling of the load collar 170. The handles may be attached to the cut-out 177 of the load collar 170. In one embodiment, when not in use, the handle 171 may be retracted into the cut-out 177 such that the handle 171 does not protrude out of the body of the load collar 168. In FIG. 9, one handle 171 is shown retracted into a cut-out 177, and one handle 171 is shown extended out of another cut-out 177. In one embodiment, the handles 171 may be coupled to a spring activated pin 176 which is configured to lock the position of the handles 171. For example, the spring activated pin 176 may bias the handle 171 in or out of a recess 178 in order to lock the position of the handle 171.

Referring back to FIG. 3, the upper surface of the load collar 160 may support a stabbing guide 165, which may be used to facilitate alignment of the next screen 22 or tubular to be connected to the first screen 21. In one embodiment, the stabbing guide 165 is tubular shaped and may include two portions that are coupled each other. The inner diameter of the stabbing guide 165 is sufficiently sized to accommodate the first screen 21 and to rest on the load collar 160. The upper end of the stabbing guide 165 may be funnel shaped to facilitate alignment of the next screen 22 to the first screen 21. In another embodiment, the stabbing guide 165 may be positioned on the box of the first screen 21 and used to guide the second screen 22 into alignment with the first screen 21.

In operation, the load collar 160 and the collar support 150 may be used to connect one or more screens to each other. As shown in FIG. 3, the collar support 150 is configured to support a first screen 21 via the load collar 160. The load collar 160 may be pre-installed prior to being lifted by the traveling block 8. In another embodiment, the load collar 160 may be installed on the first screen 21 just before the first screen 21 lands on the upper end of the collar support 150. As shown, the collar support 150 is supported on a shock absorber 155 via the plate 158 to absorb load transfer shocks. Before the second screen 22 is added, the stabbing guide 165 is positioned around the first screen 21 and on the load collar 160. Thereafter, the second screen 22 is lowered and stabbed into the first screen 21. After removing the stabbing guide 165, the two screens 21, 22 are threadedly connected to each other using, for example, a tong. Thereafter, the single joint elevator 37 is lowered relative to the second screen 22 to remove the load of the second screen 22 from the single joint elevator 37.

Figure 4:
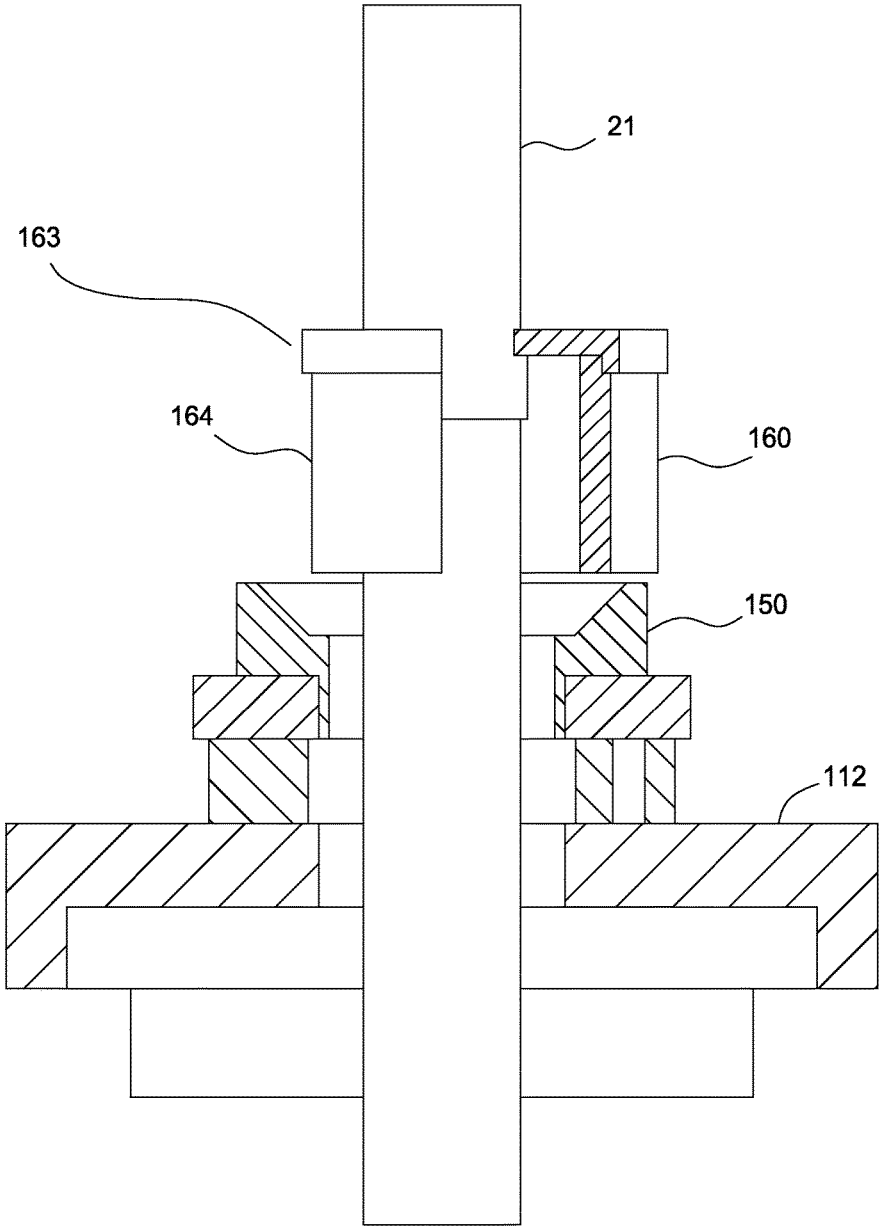
FIGS. 4-6 show an exemplary sequence of running a screen of FIG. 3.
Figure 6:
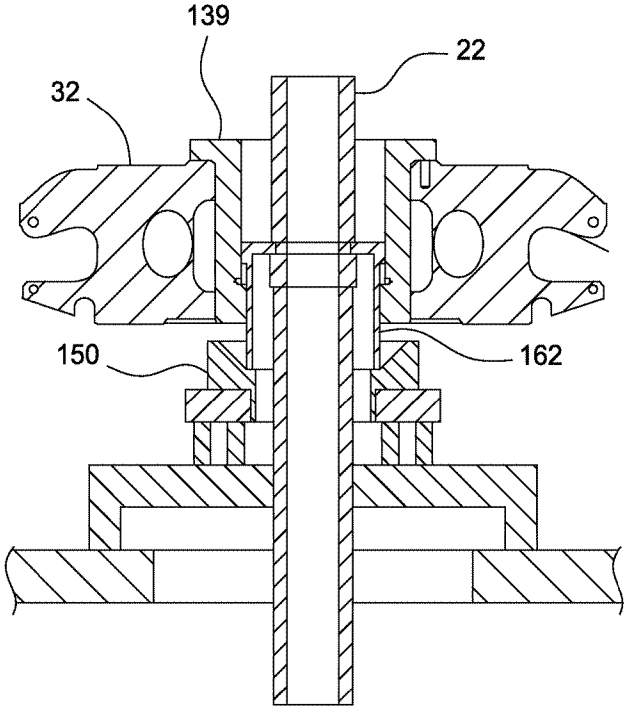
Figure 5:
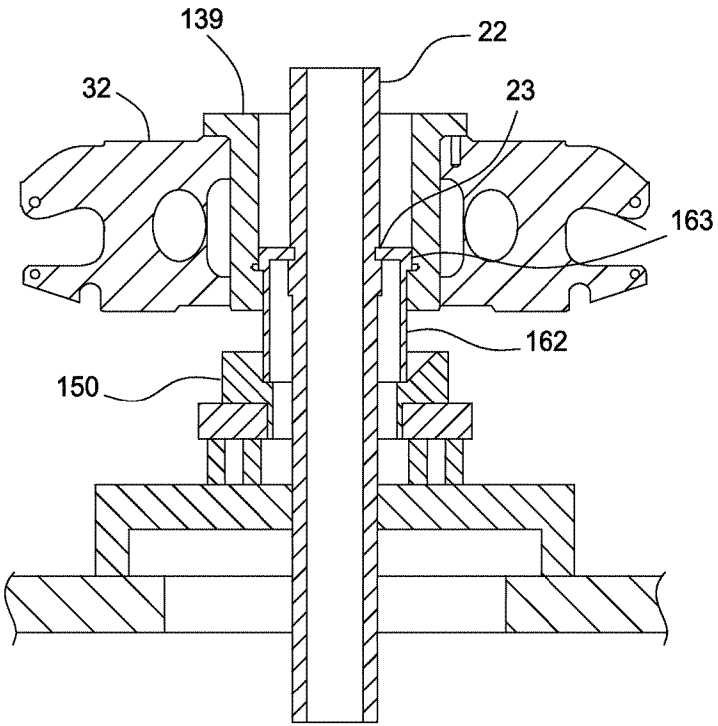

Referring now to FIG. 4, after making up the connection, the load collar 160 is removed from the first screen 21. The ASD 32 is used to grip the load collar 162 of the second screen 22. Then, the sliding collar table 112 is opened, and the first screen 21 and the second screen 22 are lowered through the collar support 150 and the sliding collar table 112. The ASD 32 supports the entire weight of the screens 21, 22 as the screens 21, 22 are lowered. In FIG. 5, the two halves of the collar support 150 are closed around the second screen 22. As shown, the ASD 32 is equipped with an optional bushing 139 configured to engage the flange 163 of the load collar 162 of the second screen 22. In one embodiment, the bushing 139 is configured to support an outer portion (e.g., the flange 163) of the lower surface of the load collar 162. In another embodiment, the ASD 32 may be configured to engage the flange 163 of the load collar 162. After the load collar 162 lands on the collar support 150, the weight of the screens 21, 22 is transferred to the collar support 150 as shown in FIG. 6. Thereafter, the ASD 32 is lowered relative to the load collar 162, and then opened and moved away from the load collar 162. This process may be repeated to add one or more screens or tubulars. In this manner, one or more screens having a small gripping area may be connected to each other.

Figure 10:
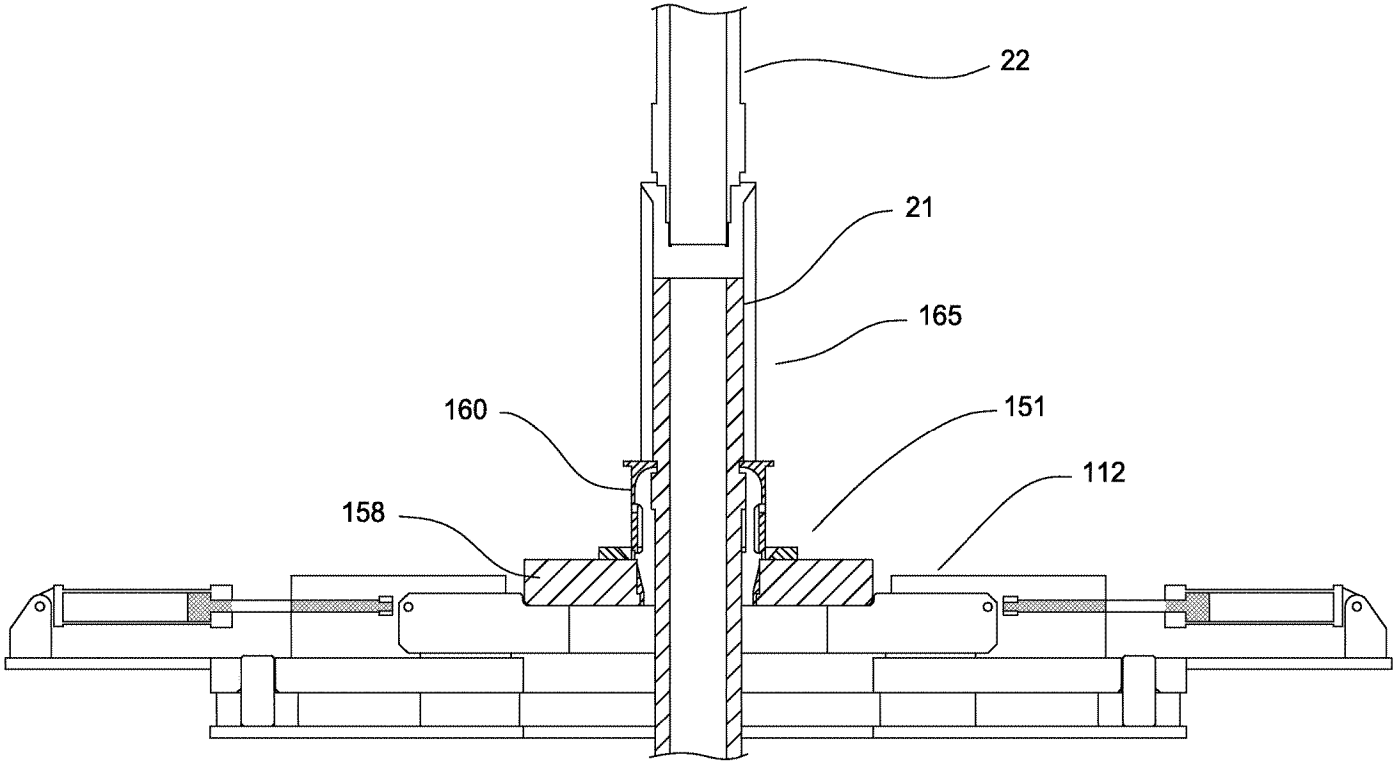
FIGS. 10-17 illustrate an exemplary embodiment of a tubular running procedure using the load collar.

FIGS. 10-17 illustrate an exemplary embodiment of a tubular running procedure using the load collar. In this embodiment, the tubular is a screen. Referring to FIG. 10, the sliding collar table 112 is shown in the closed position and includes a load transfer member such as a plate 158. In this embodiment, the load collar 160 is supported by the plate 158. The collar support is disposed on the plate and acts as a centralizer 151 to guide the load collar 160 during landing of the load collar 160 on the plate 158.

During make up, an optional stabbing guide 165 is positioned on the load collar 160 to assist with alignment of the second screen 22 with the first screen 21. The single joint compensator 12 may be used during make up of the connection between the screens 21, 22.

Figure 11:
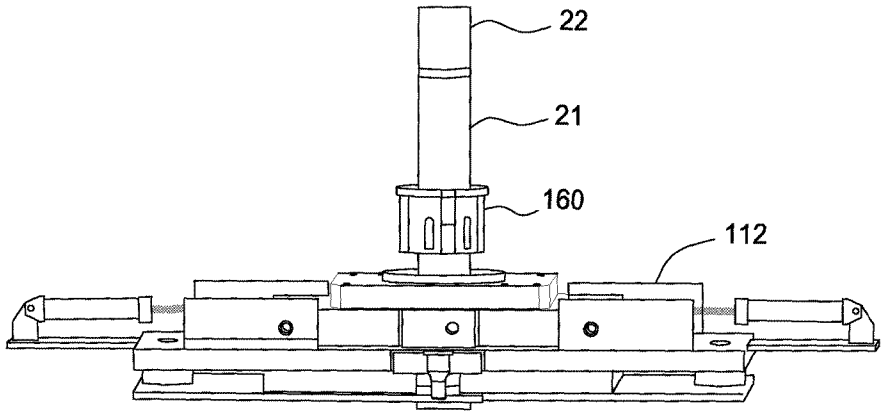
Figure 12:
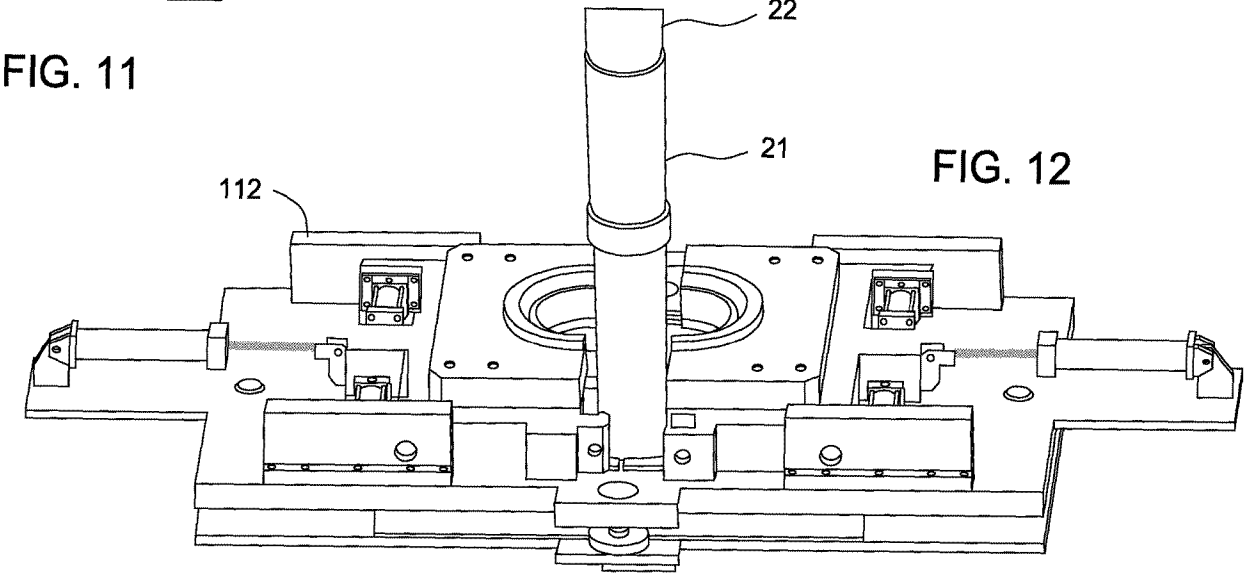

After make up, the load collar 162 on the second screen 22 is secured to the ASD 32. Thereafter, the connected string 21, 22 is raised slightly above the sliding collar table 112, as shown in FIG. 11. The load collar 160 on the first screen 21 is removed, and the sliding collar table 112 is partially opened, as shown in FIG. 12. Thereafter, the connected string 21, 22 is lowered into the hole.

Figure 13:
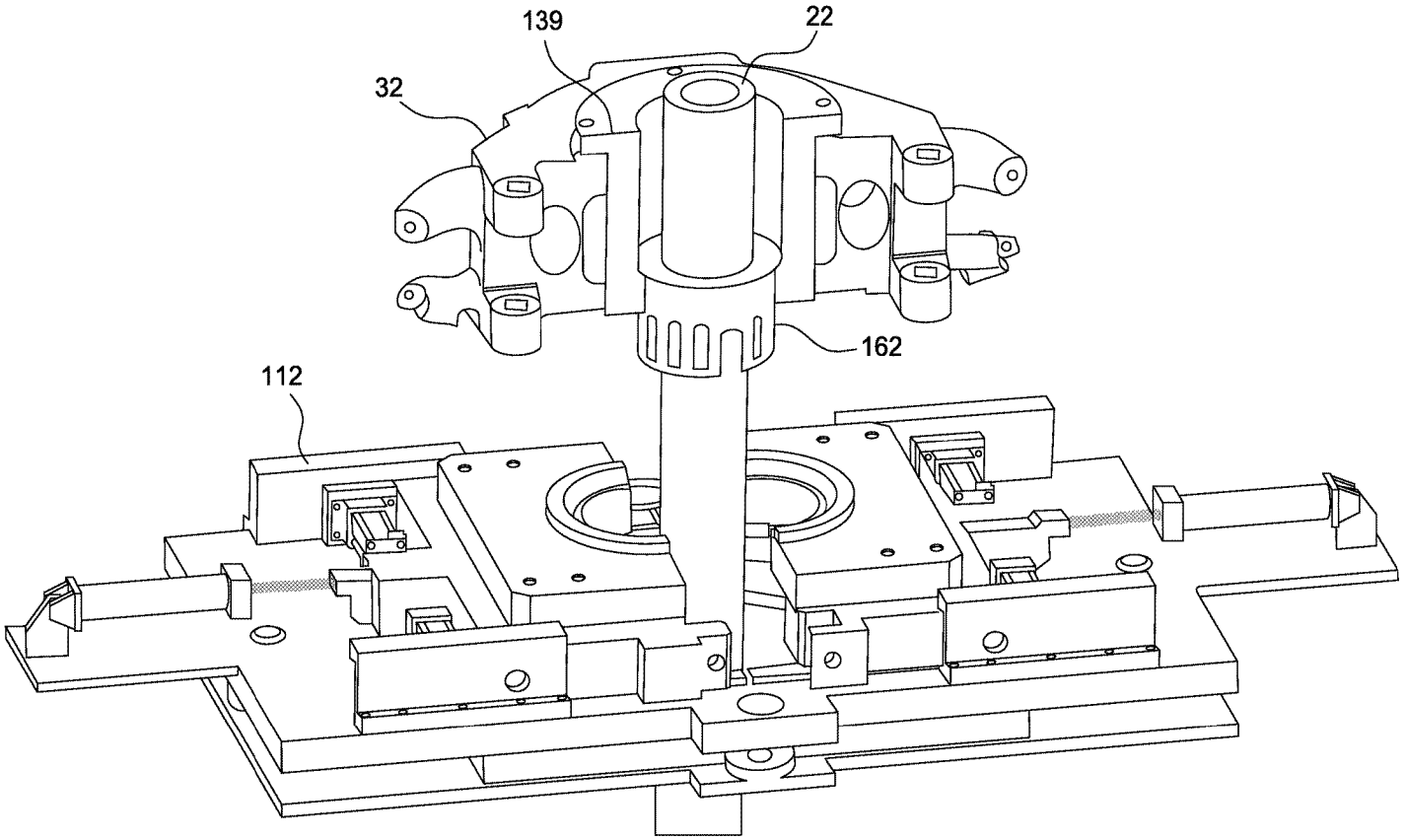
Figure 14:
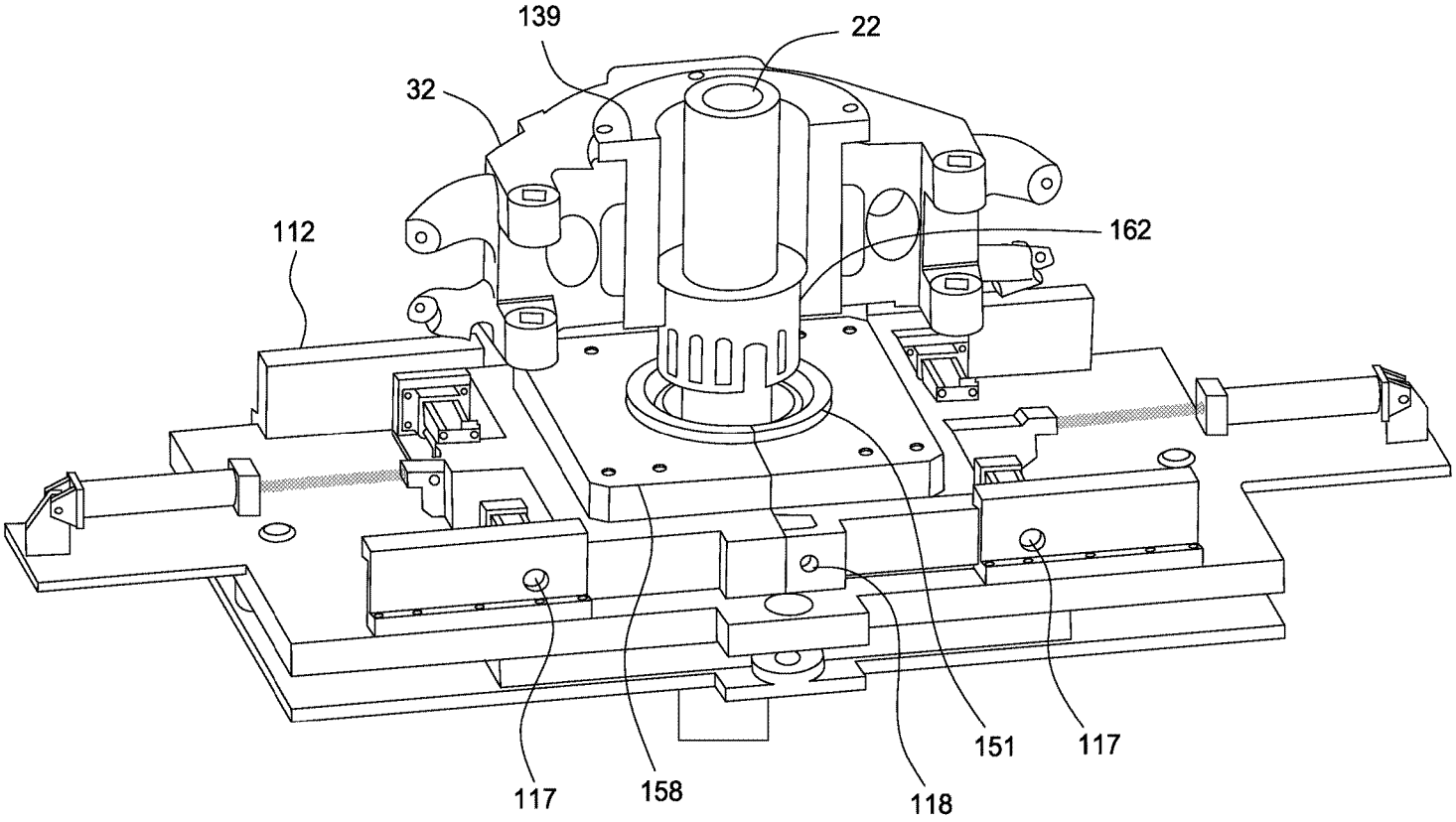

FIG. 13 shows the ASD 32 lowering the connected string 21, 22 until the load collar 162 of the second screen 22 is just above the sliding collar table 112. As shown, the load collar 162 on the second screen 22 is supported by the bushing 139 in the ASD 32. The bushing 139 is in contact with the flange 163 of the collar 162. In FIG. 14, the sliding collar table 112 is closed, and one or more pins 117 are optionally used to secure sliding collar table 112 in the closed position. The positioning of the pins 117 may be automated or manual. The pins 117 may be extended for insertion into a hole in the sliding collar table 112. In another example, a combination of manual and automated pins may be used. As shown, an optional manual pin 118 is provided.

Figure 15:
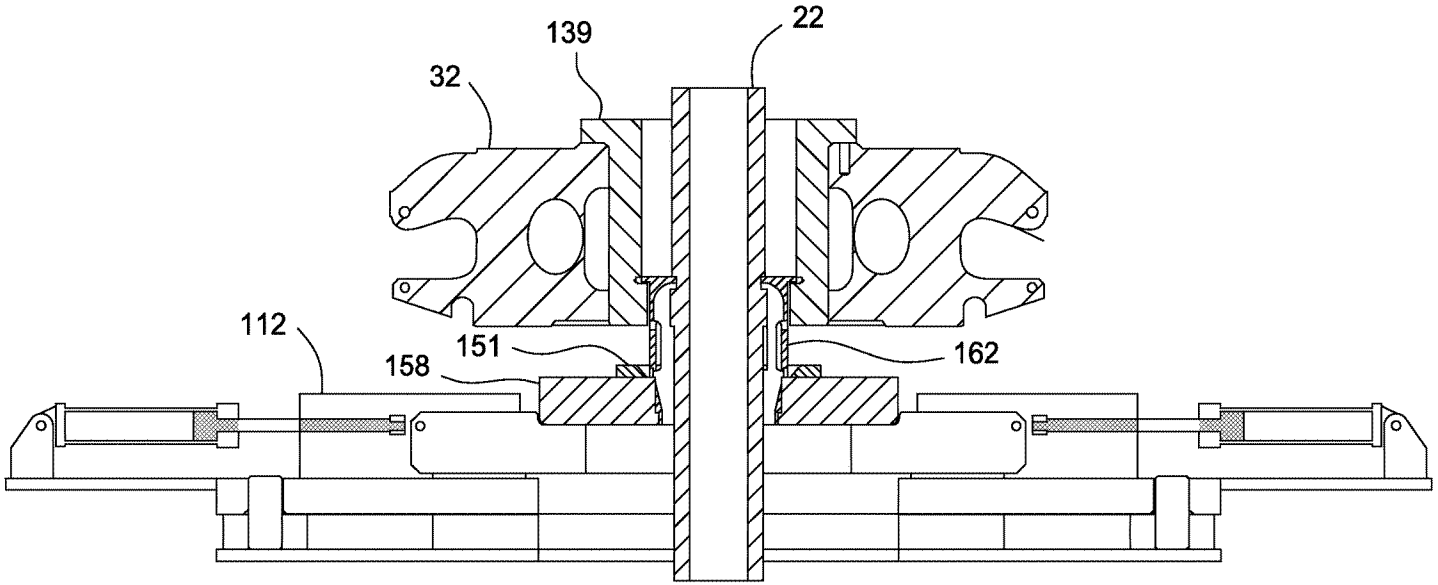

In FIG. 15, the string 21, 22 is lowered until the load collar 162 of the second screen 22 lands on the plate 158. The string 21, 22 may be guided onto the plate 158 by the centralizer 151. As shown, a clearance exists between the ASD 32 and the sliding collar table 112.

Figure 16:
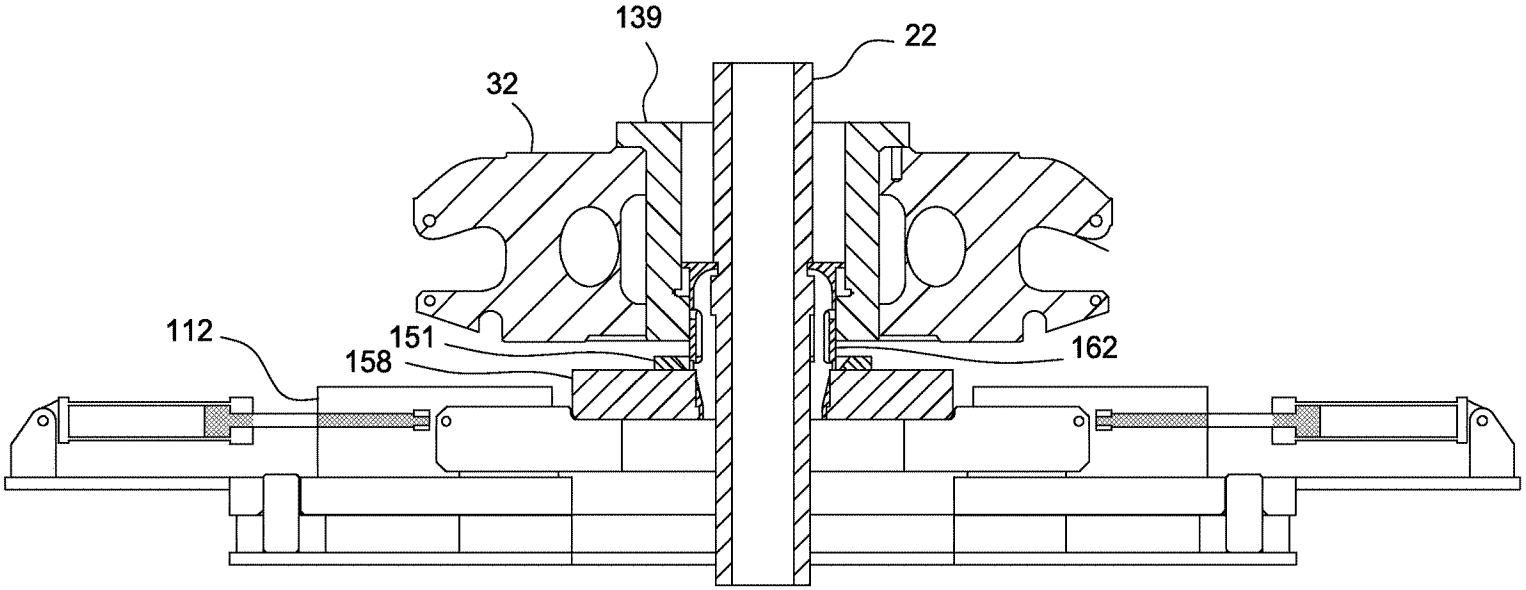
Figure 17:
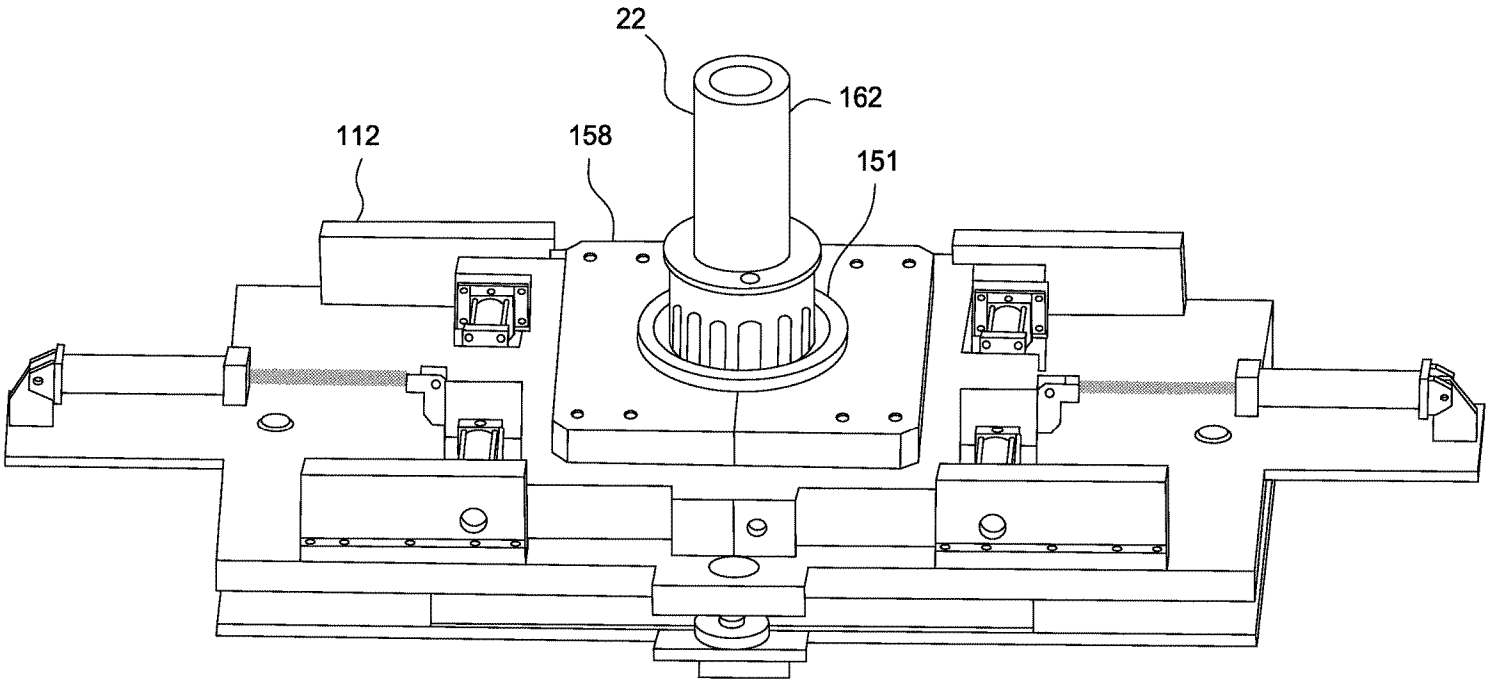

In FIG. 16, the ASD 32 is lowered so that the load of the string 21, 22 is transferred to the sliding collar table 112 via the plate 158. It can be seen that the bushing 139 of the ASD 32 has been lowered relative to the flange 163 on the load collar 162. The ASD 32 is then opened to allow removal from the load collar 162. FIG. 17 shows the sliding collar table 112 supporting the string 21, 22 via the load collar 162. The string 21, 22 is ready to receive the next screen or tubular.

Figure 18:
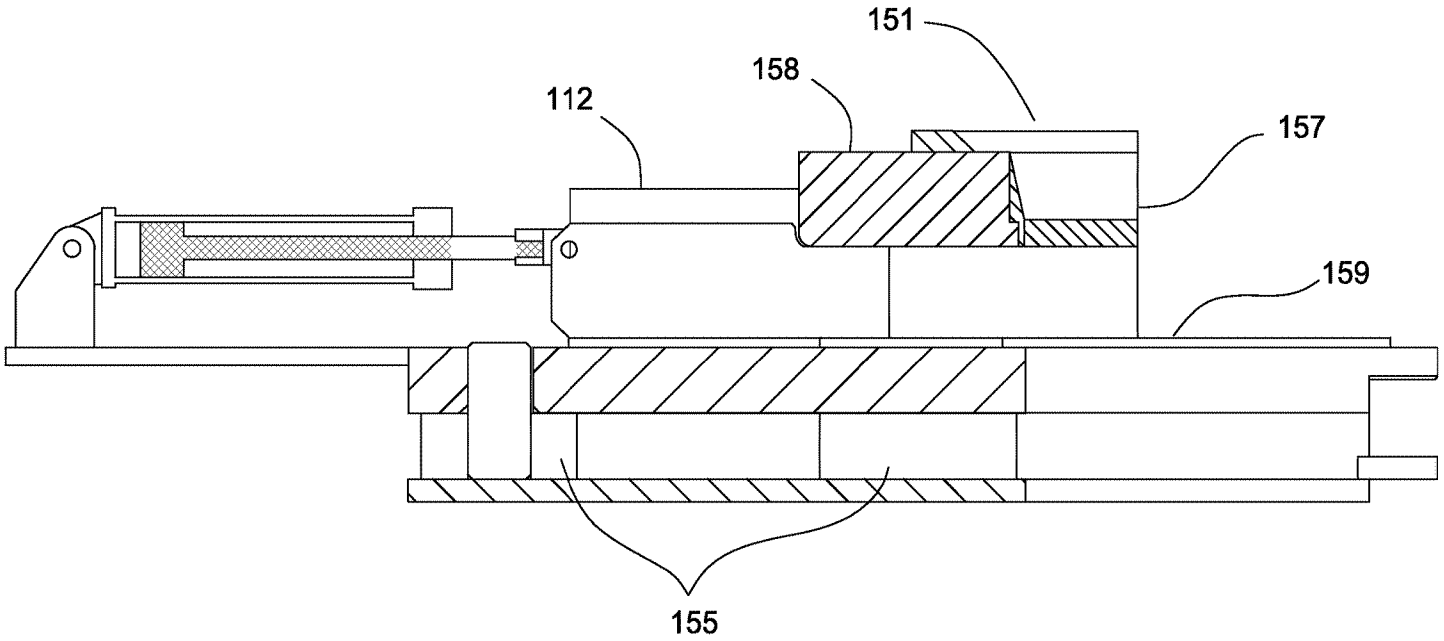
FIG. 18 shows another embodiment of a sliding collar table.

FIG. 18 shows another exemplary embodiment of the sliding collar table 112. The sliding collar table 112 may include a shock absorber 155 made of urethane and a collar centralizer 151 made of steel. In another example, a tubular guide 157 is made of polyethylene may be provided in the plate 158. In another example, a sliding pad 159 may be used to reduce friction and/or wear during opening and closing of the sliding collar table 112. An exemplary sliding pad 159 is made of polyethylene.

Figure 19:
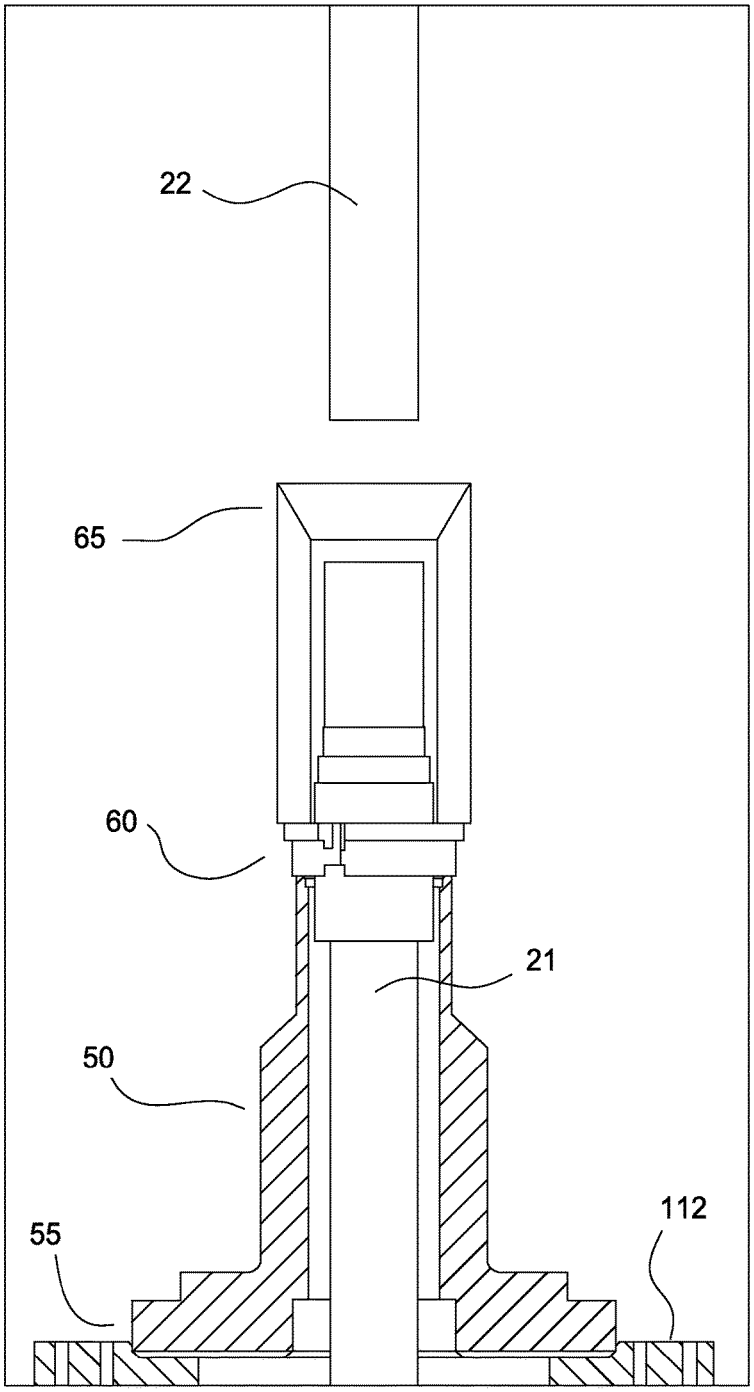
FIG. 19 illustrates another exemplary tubular handling system.

FIG. 19 illustrates a screen or a string of screens 21, 22 supported by another embodiment of a load support member such as a load spear 50. The load spear 50 sits on a sliding collar table 112. An optional shock absorber 55 may be provided below the load spear 50 to absorb load transfer shocks, such as during landing of the screen 21 on the load spear 50. In one embodiment, the sliding collar table 112 includes guides inside the master bushing to allow for any slight misalignment. In one embodiment, the load spear 50 is tubular shaped and includes two halves that can separate from each other. For example, the two halves can be brought together to support the screen 21 and moved apart to allow the screen 21 to pass through. In one embodiment, the two halves of the load spear 50 are coupled together using a connection member such as a hinge. In another embodiment, the two halves are not physically coupled to each other.

In one embodiment, a load collar 60 is installed on the screen 21. For example, the load collar 60 may engage the gripping area 23 on the screen 21. In one example, the load collar 60 has an annular shape and includes at least two portions that are coupled to each other to allow opening and closing of the load collar 60. The load collar 60 has an outer diameter that is larger than the screen 21. The lower surface of the load collar 60 is sufficiently sized for engagement with the load spear 50 when the load spear 50 is brought together.

The upper surface of the load collar 60 may support a stabbing guide 65 to facilitate alignment of a screen 22 or tubular to be connected to the screen 21 in the load spear 50. In one embodiment, the stabbing guide 65 is tubular shaped and may include two portions that are coupled each other. The inner diameter of the stabbing guide 65 is sufficiently sized to accommodate the screens 21, 22 and to sit on the load collar 60. The upper end of the stabbing guide 65 may be funnel shaped to facilitate alignment of the next screen 22 to the screen 21.

In operation, the load spear 50 may be used to connect one or more screens 21, 22 to each other. As shown in FIG. 19, the load spear 50 is configured to support a first screen 21 via the load collar 60, as shown in FIG. 19. The load collar 60 may be pre-installed prior to being lifted by the traveling block. In another embodiment, the load collar 60 may be installed on the first screen 21 just before the first screen 21 lands on the upper end of the load spear 50. As shown, the load spear 50 is supported on a shock absorber 55 to absorb load transfer shocks. Before the second screen 22 is added, the stabbing guide 65 is positioned around the first screen 21 and on the load collar 60. Thereafter, the second screen 22 is lowered and stabbed into the first screen 21. The two screens 21, 22 are threadedly connected to each other using, for example, a tong. Thereafter, the single joint elevator 37 is lowered relative to the second screen 22 to remove the load of the second screen 22 from the single joint elevator 37.

Figure 20:
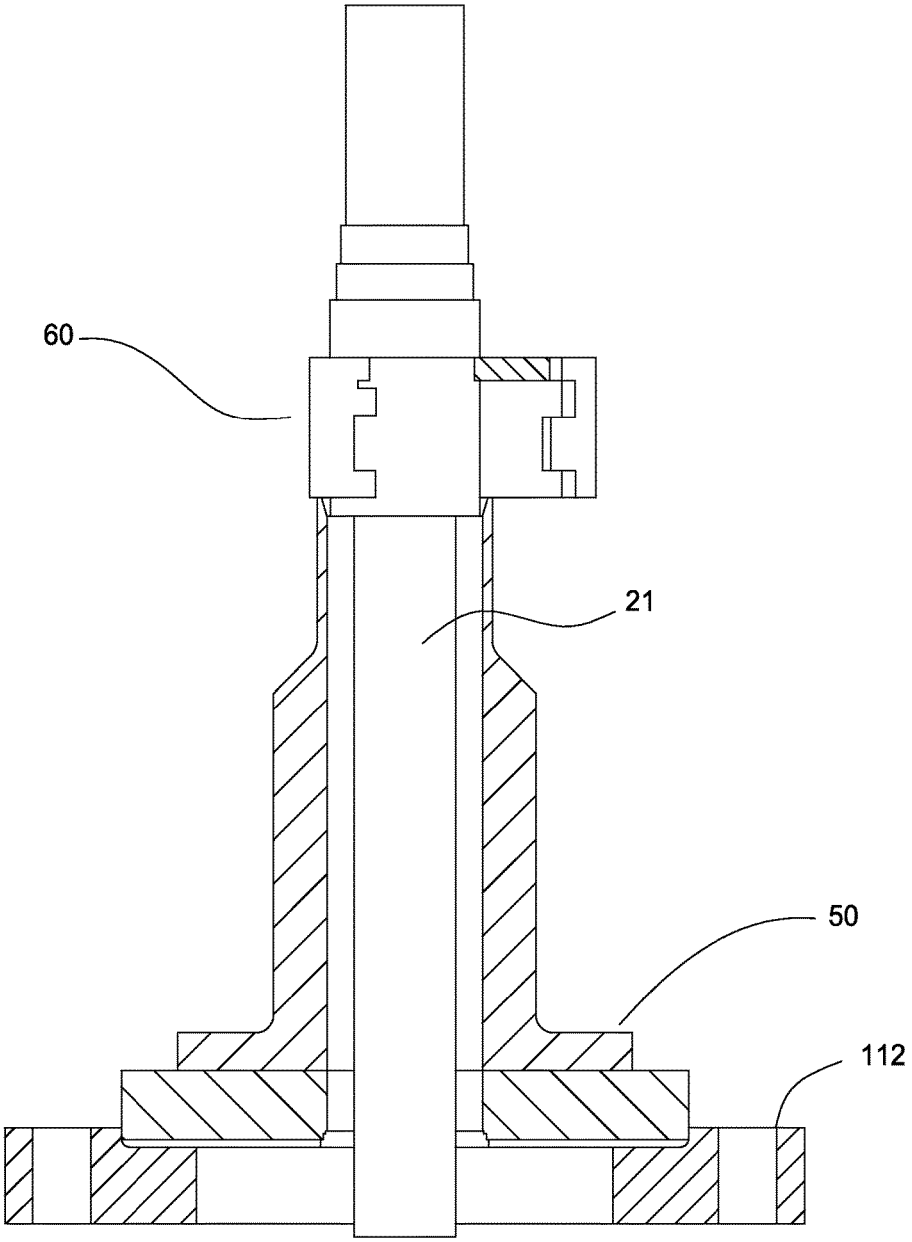
FIGS. 20-22 show an exemplary sequence of running a screen of FIG. 19.
Figure 22:
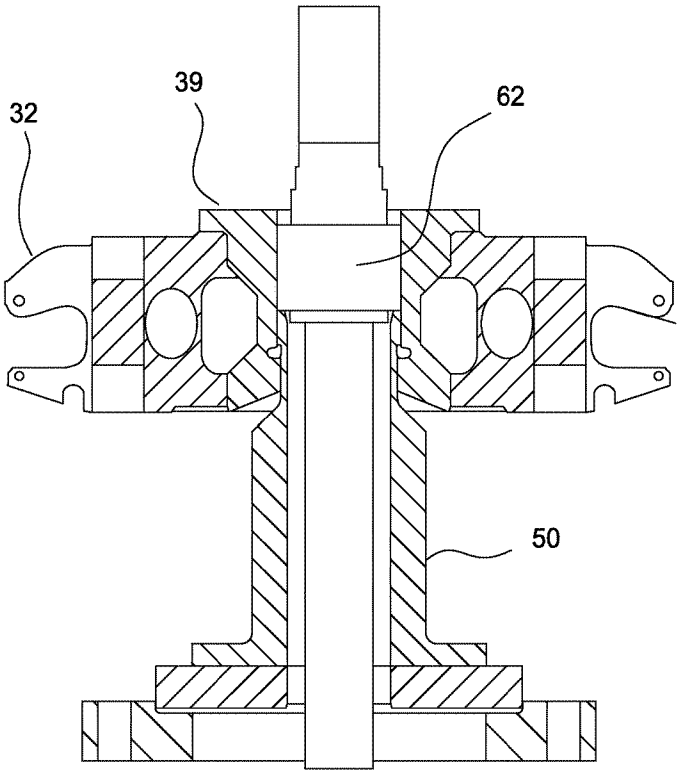
Figure 21:
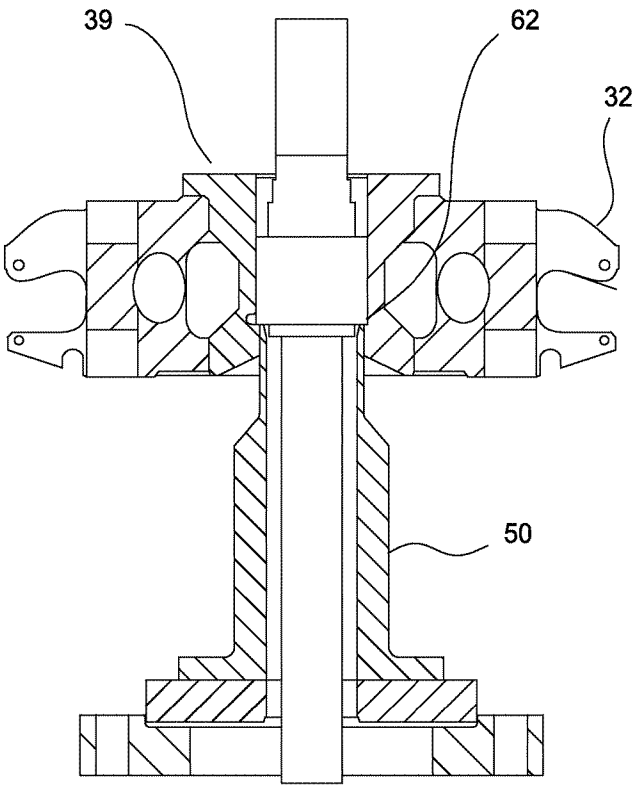

Referring now to FIG. 20, after connection, the load collar 60 is removed from the first screen 21. Then, the ASD 32 is used to grip the load collar 62 of the second screen 22. After make up, the load spear 50 is opened to allow the screens 21, 22 to pass through sliding collar table 112. In one embodiment, the load spear 50 may be hydraulically opened. The ASD 32 supports the entire weight of the screens 21, 22 as the screens 21, 22 are lowered. In FIG. 21, the two halves of the load spear 50 are brought together to close the load spear 50. As shown, the ASD 32 is equipped with a bushing 39 configured to engage a profile of the load collar 62 of the second screen 22. In one embodiment, the bushing 39 is configured to support an outer portion of the lower surface of the load collar 62. The bushing 39 is sized to allow the load spear 50 to engage an inner portion of the load collar 62 while the load collar 62 is still supported by the ASD 32. After the load collar 62 lands on the load spear 50, the weight of the screens 21, 22 is transferred to the load spear 50 as shown in FIG. 22. Thereafter, the ASD 32 is opened and moved away from the load collar 62. This process may be repeated to add one or more screens or tubulars. In this manner, one or more screens 21, 22 having a small gripping area 23 may be connected to each other.

Figure 23:
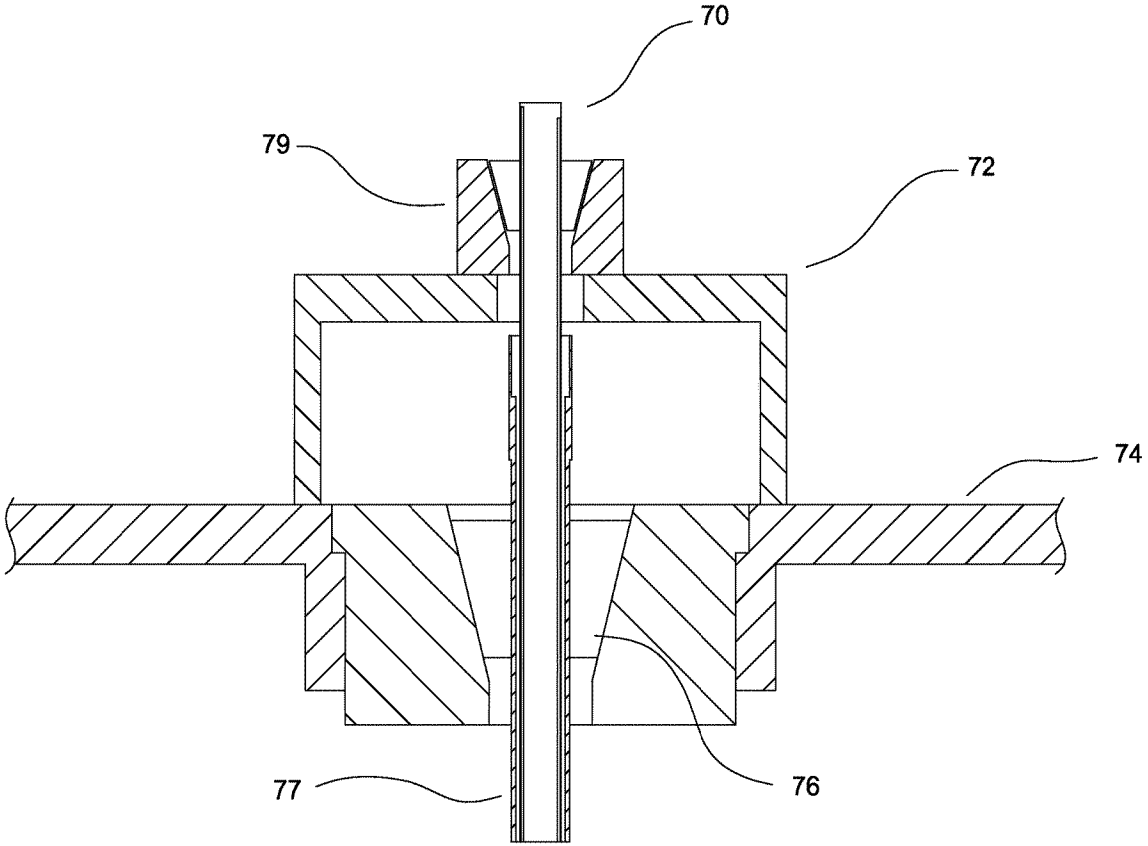
FIG. 23 illustrates an exemplary wash pipe installation system.

FIG. 23 illustrates an exemplary process and apparatus for installing a wash pipe 70. The wash pipe 70 may be disposed inside a tubular 77 such as a screen, a pipe, and/or a casing. As shown, a false rotary table 72 is disposed on a rotary table 74. The rotary table 74 includes slips 76 to support the tubular 77 connected to the upper portion of a lower completion, which may include one or more screens. Another set of slips 79 are positioned on the false rotary table 72 to grip a wash pipe 70 that may be inserted into the tubular 77 for circulating fluid. The false rotary table 72 may slide open or closed to allow passage of the wash pipe 70 while it is being made up and run-in to the wellbore.

A method of connecting tubulars includes rigging up a ASD with an optional bushing and the single joint compensator system. The method may optionally include rigging up a hydraulically operated tong for screen make up and wash pipe make up. The tong may optionally include a joint analyzed make up system and non-marking jaws such as for corrosion resistant alloy applications. A spider may be installed in the master bushing, and the load collar slips may be installed on the sliding collar table. An optional dropped object mat may be installed. The load collar may be pre-installed on the screens. The screen stabbing guide, dope application, and CRA protective coverings are optionally prepared for use.

In operation, the screen is hoisted via the single joint elevator that is coupled to the single joint compensator. Then, the screen is lowered above the connection and the single joint compensator is engaged. The initial make up process may optionally be performed manually by hand. The make up process may continue by using a power tong. After make up, the screens are run into the hole. This process may be repeated until the desired number of screens has been made up. After the screens have been made up, the hand slips are actuated to grip the base pipe of the screens, thereby transferring load to the rotary master bushings.

The false rotary table is then set over the hand slips and the suspended lower completion assembly, which includes the screens. The spider bowl and slips are installed. After changing the elevator to slip type elevators, the flush joint wash pipe is run and installed. In another embodiment, wash pipe is not a flush joint. Optionally, automated flush joint elevator may be rigged up to eliminate the need for wash pipe lift nubbins.

Then a cross-over to drill pipe is made up and run in hole with lower completion assembly using the elevator and a spider. After setting the packer, the drill pipe is retrieved and racked back, and the wash pipe is laid out. The remote control stand is configured to control line angle, and the auto clamp control line handling system is installed.

Then, the remote control stand is prepared for handling the upper completion assemblies. The control lines may be used to run the production tubing.

In another embodiment, a method of running tubulars includes attaching a load collar to a first tubular; landing the load collar on a load support member; connecting a second tubular to the first tubular; removing the load collar from the first tubular; and lowering the first tubular and the second tubular.

In another embodiment, a method of running tubular includes installing a load collar on a first tubular; landing the load collar on a load support member; positioning a stabbing guide on the load collar; and connecting a second tubular to the first tubular.

In one or more of the embodiments described herein, the load support member comprises a centralizer configured to support the load collar.

In one or more of the embodiments described herein, the load support member comprises a load spear.

In one or more of the embodiments described herein, the load support member comprises a plate.

In one or more of the embodiments described herein, the method includes guiding the load collar onto the plate.

In one or more of the embodiments described herein, a centralizer is used to guide the load collar.

In one or more of the embodiments described herein, the first tubular and the second tubular are lowered until a second load collar on the second tubular lands on the load support member.

In one or more of the embodiments described herein, the load collar attaches to a recess on the first tubular.

In one or more of the embodiments described herein, an elevator is used to lower the first tubular and the second tubular.

In one or more of the embodiments described herein, the elevator supports a second load collar while lowering the first tubular and the second tubular.

In one or more of the embodiments described herein, the elevator and the load support member are used simultaneously support a second load collar.

In one or more of the embodiments described herein, the elevator engages a flange on an upper portion of the second load collar.

In one or more of the embodiments described herein, at least one of the first tubular and the second tubular includes a screen.

While the foregoing is directed to embodiments of the present invention, other and further embodiments of the invention may be devised without departing from the basic scope thereof, and the scope thereof is determined by the claims that follow.

The invention claimed is:

1. A method of running tubulars, comprising:

attaching a load collar to a recess of a first tubular, the recess being recessed from a first outer diameter of the first tubular, and the load collar having a second outer diameter larger than the first outer diameter of the first tubular, wherein a top surface of the load collar disposed in the recess is engaged with the first tubular to axially support the tubular;

engaging the load collar attached to the first tubular using an elevator;

lowering a bottom surface of the load collar onto a load support member using the elevator;

connecting a second tubular to the first tubular;

disengaging the elevator from the load collar;

removing the load collar from the first tubular; and lowering the first tubular and the second tubular.

2. The method of claim 1, wherein lowering the first tubular and the second tubular comprises lowering the first tubular and the second tubular until a second load collar on the second tubular lands on the load support member.

3. The method of claim 1, further comprising:

attaching a second load collar to the second tubular, and wherein the elevator supports the second load collar while lowering the first tubular and the second tubular.

4. The method of claim 3, further comprising simultaneously supporting the second load collar using the elevator and the load support member.

5. The method of claim 3, wherein the elevator engages a flange on an upper portion of the second load collar.

6. The method of claim 1, wherein at least one of the first tubular and the second tubular comprises a screen.

7. The method of claim 1, wherein the first outer diameter of the first tubular is the outermost outer diameter of the first tubular.

8. The method of claim 1, wherein the bottom surface of the load collar has an inner diameter larger than the outer diameter of the first tubular.

9. The method of claim 1, wherein a portion of the bottom surface of the load collar is disposed outside of the recess.

10. A method of running tubulars, comprising:

attaching a load collar to a first tubular;

landing the load collar on a load support member;

positioning a stabbing guide on the load collar after landing on the load support member; and threadedly connecting a second tubular to the first tubular.

11. The method of claim 10, wherein at least one of the first tubular and the second tubular comprises a screen.

12. The method of claim 10, further comprising using an elevator to support the first and second tubulars.

13. The method of claim 12, wherein the elevator supports a portion of a second load collar attached to the second tubular.

14. The method of claim 13, further comprising simultaneously supporting the second load collar using the elevator and the load support member.

15. The method of claim 13, wherein the elevator engages a flange on an upper portion of the second load collar.

16. The method of claim 10, wherein the load support member comprises a centralizer configured to support the load collar.

17. The method of claim 10, wherein the load support member comprises a load spear.

18. The method of claim 10, wherein the load support member comprises a plate.

19. The method of claim 18, further comprising guiding the load collar onto the plate.

20. The method of claim 19, wherein a centralizer is used to guide the load collar.

21. The method of claim 10, further comprising removing the stabbing guide after lowering the second tubular through the stabbing guide onto the first tubular and prior to threadedly connecting the first tubular to the second tubular.

22. The method of claim 10, wherein the load collar attaches to a recess on the first tubular.

23. The method of claim 10, further comprising:
removing the load collar from the first tubular; and
lowering the first tubular and the second tubular.

24. The method of claim 23, further comprising attaching a second load collar to the second tubular before lowering the first tubular and the second tubular.

25. The method of claim 10, wherein landing load collar comprises engaging an outer portion of a bottom surface of the load collar with the load support member.

26. A method of running tubulars, comprising:
attaching a load collar to a first tubular;
landing the load collar on a load support member;
positioning a stabbing guide on the load collar;
lowering a second tubular through the stabbing guide onto the first tubular;
threadedly connecting the second tubular to the first tubular; and
removing the stabbing guide after lowering a second tubular through the stabbing guide onto the first tubular and prior to threadedly connecting the first tubular to the second tubular.

* * * * *